US008723745B2

(12) United States Patent
Amari et al.

(10) Patent No.: US 8,723,745 B2
(45) Date of Patent: May 13, 2014

(54) ANTENNA APPARATUS INCLUDING MULTIPLE ANTENNA PORTIONS ON ONE ANTENNA ELEMENT OPERABLE AT MULTIPLE FREQUENCIES

(75) Inventors: Satoru Amari, Osaka (JP); Atsushi Yamamoto, Kyoto (JP); Tsutomu Sakata, Osaka (JP)

(73) Assignee: Panasonic Corporation, Osaka (JP)

( * ) Notice: Subject to any disclaimer, the term of this patent is extended or adjusted under 35 U.S.C. 154(b) by 342 days.

(21) Appl. No.: 13/125,373

(22) PCT Filed: May 25, 2010

(86) PCT No.: PCT/JP2010/003483

§ 371 (c)(1), (2), (4) Date: Jul. 5, 2011

(87) PCT Pub. No.: WO2011/024355

PCT Pub. Date: Mar. 3, 2011

(65) Prior Publication Data

US 2011/0254749 A1 Oct. 20, 2011

(30) Foreign Application Priority Data

Aug. 25, 2009 (JP) ..... 2009-194062

(51) Int. Cl.
*H01Q 9/00* (2006.01)

(52) U.S. Cl.
USPC ..... 343/750; 343/702

(58) Field of Classification Search
USPC ..... 343/750, 702, 795
See application file for complete search history.

(56) References Cited

U.S. PATENT DOCUMENTS

| | | | |
|---|---|---|---|
| 6,836,248 | B2 | 12/2004 | Fukushima et al. |
| 7,352,328 | B2 | 4/2008 | Moon et al. |
| 7,688,273 | B2 | 3/2010 | Montgomery et al. |
| 7,688,275 | B2 | 3/2010 | Montgomery et al. |

(Continued)

FOREIGN PATENT DOCUMENTS

| | | |
|---|---|---|
| JP | 2004-32303 | 1/2004 |
| JP | 2007-97167 | 4/2007 |

(Continued)

OTHER PUBLICATIONS

International Search Report issued Aug. 31, 2010 in International (PCT) Application No. PCT/JP2010/003483.
International Preliminary Report on Patentability issued Mar. 22, 2012 in International (PCT) Application No. PCT/JP2010/003483.

*Primary Examiner* — Ahshik Kim
(74) *Attorney, Agent, or Firm* — Wenderoth, Lind & Ponack, L.L.P.

(57) ABSTRACT

An antenna element has first and second feed ports, and is simultaneously excited through the feed ports so as to simultaneously operate as first and second antenna portions respectively, associated with the feed ports. The antenna element is excited at one of a first frequency and a second frequency higher than the first frequency. An antenna apparatus is provided with: a slit that provides isolation between the feed ports; a trap circuit that allows the slit to provide isolation at the first or second frequency when the antenna element is excited at the first or second frequency; and a reactance element that shifts a frequency at which the slit provides isolation between the feed ports, to the first frequency, when the antenna element is excited at the first frequency.

12 Claims, 10 Drawing Sheets

(56) References Cited

U.S. PATENT DOCUMENTS

| | | | | |
|---|---|---|---|---|
| 8,264,414 | B2 * | 9/2012 | Sakata et al. | 343/702 |
| 2005/0001777 | A1 * | 1/2005 | Suganthan et al. | 343/795 |
| 2008/0143613 | A1 | 6/2008 | Iwai et al. | |
| 2010/0265146 | A1 | 10/2010 | Montgomery et al. | |
| 2011/0021139 | A1 | 1/2011 | Montgomery et al. | |
| 2011/0080332 | A1 | 4/2011 | Montgomery et al. | |

FOREIGN PATENT DOCUMENTS

| | | |
|---|---|---|
| JP | 2008-167421 | 7/2008 |
| JP | 2009-521898 | 6/2009 |
| WO | 02/075853 | 9/2002 |
| WO | 2008/130427 | 10/2008 |

* cited by examiner

ANTENNA APPARATUS INCLUDING MULTIPLE ANTENNA PORTIONS ON ONE ANTENNA ELEMENT OPERABLE AT MULTIPLE FREQUENCIES

TECHNICAL FIELD

The present invention mainly relates to an antenna apparatus for mobile communication, such as for mobile phones, and relate to a wireless communication apparatus provided with the antenna apparatus.

BACKGROUND ART

The size and thickness of wireless mobile communication apparatuses, such as mobile phones, have been rapidly reduced. Portable wireless communication apparatuses have been transformed from apparatuses to be used only as conventional telephones, to data terminals for transmitting and receiving electronic mails and for browsing web pages of WWW (World Wide Web), etc. Further, since the amount of information to be handled has increased from that of conventional audio and text information to that of pictures and videos, a further improvement in communication quality is required. In addition, portable wireless communication apparatuses are required to handle various applications, including telephone call for voices, data communication for browsing web pages, watching of television broadcasts, etc. In such circumstances, an antenna apparatus operable in a wide frequency range is required for wireless communications of the respective applications.

Conventional antenna apparatuses operable in a wide frequency band and capable of adjusting the resonance frequency include, for example, an antenna apparatus in which an antenna element is provided with a slit to adjust the resonance frequency, as disclosed in Patent Literature 1, and a notch antenna having a slit provided with a trap circuit, as disclosed in Patent Literature 2.

The antenna apparatus of Patent Literature 1 is configured to include a planar radiating element (radiating plate), a ground plate opposed thereto in parallel, a feed portion located at the middle of an edge of the radiating plate for supplying a radio frequency signal, a short-circuit portion for short-circuiting the radiating plate to the ground plate near the feed portion, and two resonators formed by providing a slit on the radiating plate at an edge opposed to the feed portion. The degree of coupling of the two resonators is optimized by adjusting the shape or dimensions of this slit or by loading a reactance element or a conductor plate across the slit. Thus, a small and low-profile antenna is obtained with suitable characteristics.

In the notch antenna of Patent Literature 2, when the notch antenna should resonate in a low communication frequency band, the slit can be open at the location of the trap circuit at a radio frequency, and when the notch antenna should resonate in a high communication frequency band, the slit can be closed at the location of the trap circuit at a radio frequency. In this manner, it is possible to appropriately change the resonant length of the notch antenna according to a communication frequency band in which the notch antenna should resonate.

In addition, an antenna apparatus of Patent Literature 3 is configured to include a substrate, a plurality of planar antenna elements on the substrate, and at least one isolation element located on the substrate between the antenna elements and grounded to a ground portion. The isolation element between the antenna elements can be used to prevent mutual interference between the antenna elements, thus preventing distortion in the radiation pattern. In addition, The isolation element can operate as a parasitic antenna by grounding the isolation element to a ground plane, thus increasing output gain. In addition, the isolation element and the antenna elements can be fabricated only by etching metal films stacked on the substrate into predetermined patterns, and thus, the fabrication method can be simplified, the isolation element can be made of the metal films on the substrate, the elements can be made in a nearly two-dimensional planar structure.

CITATION LIST

Patent Literature

PATENT LITERATURE 1: PCT International Publication No. WO 2002/075853.

PATENT LITERATURE 2: Japanese Patent Laid-open Publication No. 2004-032303.

PATENT LITERATURE 3: Japanese Patent Laid-open Publication No. 2007-097167.

SUMMARY OF INVENTION

Technical Problem

Recently, antenna apparatuses using MIMO (Multi-Input Multi-Output) technology for transmitting and/or receiving radio signals of multiple channels simultaneously through space division multiplexing have appeared in order to increase communication capacity to achieve high-speed communication. In order for an antenna apparatus using MIMO communication to obtain a large communication capacity, the antenna apparatus needs to simultaneously transmit and/or receive multiple radio signals with low correlation to each other, by preventing interference between antenna elements to achieve high isolation.

In addition, since MIMO communication is performed in multiple frequency bands, e.g., an 800 MHz band and a 2000 MHz band, it is necessary to increase isolation in multiple frequency bands.

As conventional techniques for increasing isolation in multiple frequency bands, it has been known to increase the size of antenna elements, to increase the distance between the antenna elements, and to add a large electromagnetic coupling adjuster for increased isolation. However, all these techniques increase the size of an antenna apparatus. Since the volume available to mount an antenna apparatus within a mobile phone decreases year by year, it is necessary to increase isolation in multiple frequency bands while using a small antenna apparatus.

According to the configurations of Patent Literatures 1 and 2, it is possible to change the resonance frequency. However, since they have only one feed portion, there is such a problem that they cannot be used for MIMO communication, diversity communication, or adaptive arrays.

In addition, the configuration of Patent Literature 3 has a plurality of feed portions, thus available for MIMO communication, diversity communication, and adaptive arrays. However, it is not possible to achieve high isolation at multiple frequencies. In addition, the antenna elements should be separated by $\lambda/2$, and thus, there is a problem of an increase in the size of the antenna apparatus.

An object of the present invention is to solve the above-described problems, and to provide an antenna apparatus capable of simultaneously transmitting and/or receiving multiple radio signals with low correlation to each other, in multiple frequency bands, while having a simple and small configuration, and to provide a wireless communication apparatus provided with such an antenna apparatus.

Solution to Problem

According to the first aspect of the present invention, an antenna apparatus if provided. The antenna apparatus has first and second feed ports respectively provided at predetermined locations on an antenna element. The antenna element is simultaneously excited through the first and second feed ports so as to simultaneously operate as first and second antenna portions respectively associated with the first and second feed ports, and the antenna element is excited at one of a first frequency and a second frequency higher than the first frequency. The antenna apparatus is provided with: electromagnetic coupling adjusting means provided between the first and second feed ports, the electromagnetic coupling adjusting means providing isolation between the first and second feed ports at each of the first and second frequencies; a trap circuit provided on the electromagnetic coupling adjusting means, the trap circuit that allows the electromagnetic coupling adjusting means to provide the isolation at the first frequency when the antenna element is excited at the first frequency, and allows the electromagnetic coupling adjusting means to provide the isolation at the second frequency when the antenna element is excited at the second frequency; and first resonance frequency adjusting means provided on the electromagnetic coupling adjusting means, the first resonance frequency adjusting means shifting a frequency at which the electromagnetic coupling adjusting means provides isolation between the first and second feed ports, to the first frequency, when the antenna element is excited at the first frequency.

In the antenna apparatus, when the antenna element is excited at the first frequency, the trap circuit is substantially open, and a first current path is formed on the antenna element and between the first and second feed ports, the first current path not passing through the trap circuit, and when the antenna element is excited at the second frequency, the trap circuit is substantially short-circuited, and a second current path is formed on the antenna element and between the first and second feed ports, the second current path passing through the trap circuit.

In the antenna apparatus, the first resonance frequency adjusting means is a reactance element.

In the antenna apparatus, the first resonance frequency adjusting means is a variable reactance element. The antenna apparatus is further provided with control means controlling a reactance value of the variable reactance element.

The antenna apparatus is further provided with second resonance frequency adjusting means provided on the electromagnetic coupling adjusting means, the second resonance frequency adjusting means shifting a frequency at which the electromagnetic coupling adjusting means provides isolation between the first and second feed ports, to the second frequency, when the antenna element is excited at the second frequency.

In the antenna apparatus, the electromagnetic coupling adjusting means is a slit provided on the antenna element. The trap circuit is provided at a location along the slit and remote from an opening of the slit by a predetermined distance. The first resonance frequency adjusting means is provided at a location along the slit and more remote from the opening of the slit than the trap circuit.

In the antenna apparatus, the electromagnetic coupling adjusting means is a slot provided on the antenna element, and the slot has a first end close to the first and second feed ports, and a second end remote from the first and second feed ports. The trap circuit is provided at a location along the slot and remote from the first and second ends by predetermined distances. The first resonance frequency adjusting means is provided along the slot between the trap circuit and the second end.

In the antenna apparatus, the trap circuit is formed by connecting a series resonant circuit in series with a parallel resonant circuit, the series resonant circuit including a first inductor and a first capacitor, and the parallel resonant circuit including a second inductor and a second capacitor.

In the antenna apparatus, the trap circuit is formed by connecting a series resonant circuit, including an inductor and a first capacitor, in parallel with a second capacitor.

In the antenna apparatus, the trap circuit is a band-pass filter.

In the antenna apparatus, the trap circuit is a high-pass filter.

According to the second aspect of the present invention, a wireless communication apparatus that transmits and receives multiple radio signals is provided. The wireless communication apparatus is provided with an antenna apparatus according to the first aspect of the present invention.

Advantageous Effects of Invention

As described above, according to the antenna apparatus of the present invention and the wireless communication apparatus using the antenna apparatus, it is possible to implement a MIMO antenna apparatus that allows the antenna element to resonate at multiple operating frequencies and that can ensure high isolation between the feed ports, thus operating with low coupling at each of multiple isolation frequencies. The resonance frequency of the antenna element is changed by providing the antenna element with the slit. The slit serves to increase isolation between two feed ports of the antenna element. Further, it is possible to ensure high isolation at multiple frequencies, by providing at a predetermined location across the slit, the means for forming different current paths dependent on an operating frequency (a trap circuit). It is possible to shift an isolation frequency corresponding to the lowest one of the operating frequencies of the antenna element to a further lower frequency, by providing the resonance frequency adjusting means at a predetermined location along the slit and more remote from the opening of the slit than the trap circuit. The above-described configuration leads to the size reduction of the antenna apparatus. Each of the plurality of antenna portions can achieve high efficiency by preventing interference between the feed ports to achieve high isolation.

In order to perform communication using a plurality of feed ports simultaneously, it is necessary that an antenna resonates at predetermined frequencies to operate, and the isolation between the feed ports is high. According to the present invention, it is possible to provide a wireless communication apparatus that can allow an antenna element to resonate at multiple operating frequencies, increase isolation between two feed ports at each of the operating frequencies, and thus, transmit and/or receive multiple radio signals simultaneously.

According to the present invention, while using only one antenna elements, it is possible to operate the antenna element as multiple antenna portions, and also ensure isolation between the multiple antenna portions at multiple frequency bands. By ensuring isolation and low coupling between multiple antenna portions of the MIMO antenna apparatus, it is possible to use the respective antenna portions for simultaneously transmitting and/or receiving multiple radio signals with low correlation to each other. In addition, it is possible to adjust the operating frequency of the antenna element, thus supporting applications using different frequencies.

DESCRIPTION OF EMBODIMENTS

Figure 1:
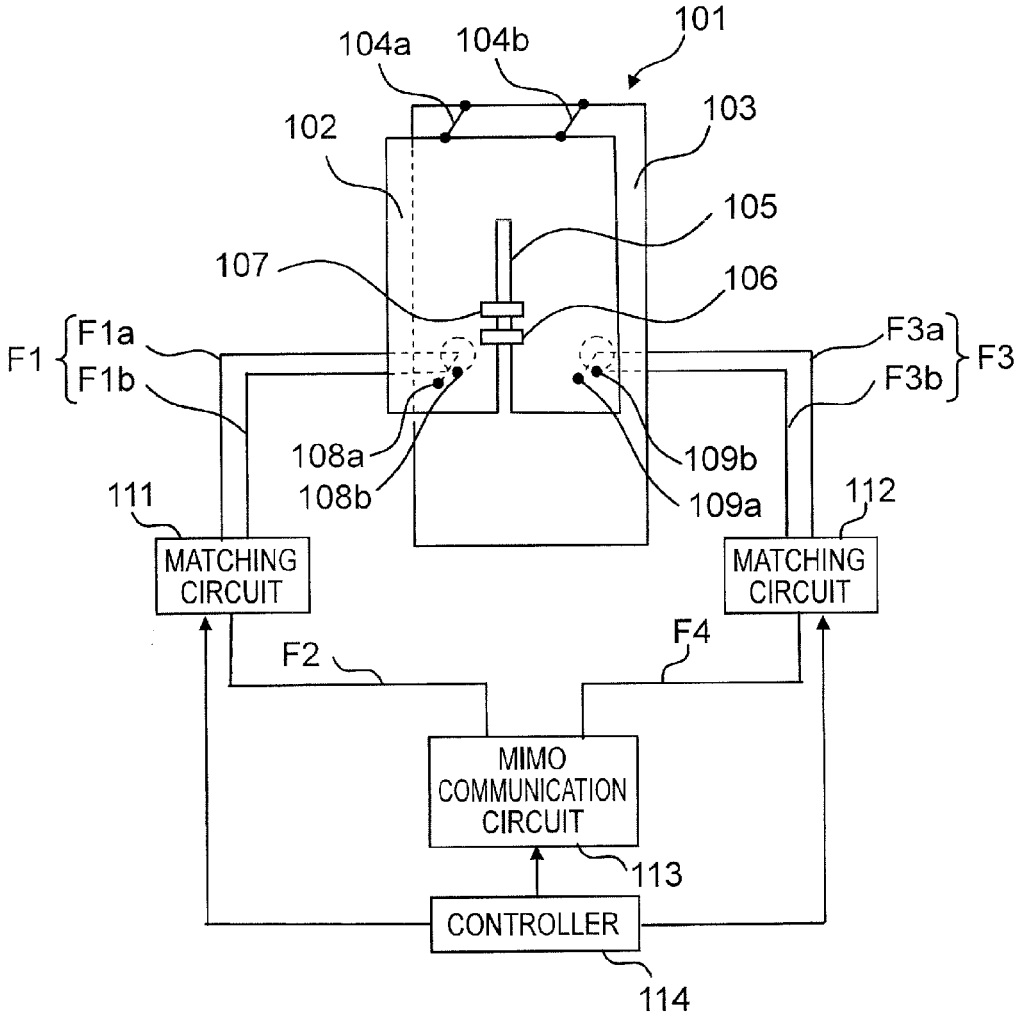
FIG. 1 is a block diagram showing schematic configurations of an antenna apparatus 101 according to a first embodiment of the present invention, and a wireless communication apparatus using the antenna apparatus 101.

Embodiments according to the present invention will be described below with reference to the drawings. Note that like components are denoted by the same reference numerals.

First Embodiment

FIG. 1 is a block diagram showing schematic configurations of an antenna apparatus 101 according to a first embodiment of the present invention, and a wireless communication apparatus using the antenna apparatus 101. The antenna apparatus of the present embodiment is provided with a rectangular antenna element 102 having two different feed points 108*a* and 109*a*, and operates the single antenna element 102 as two antenna portions by exciting the antenna element 102 through the feed point 108*a* as a first antenna portion, and simultaneously, exciting the antenna element 102 through the feed point 109*a* as a second antenna portion.

Conventionally, when a plurality of feed ports (or feed points) are provided on a single antenna element, it is not possible to ensure isolation between the feed ports, thus increasing electromagnetic coupling between different antenna portions, and increasing the correlation between signals. Therefore, for example, upon reception, the same received signals are outputted from the respective feed ports. In such a case, it is not possible to obtain good characteristics for diversity or MIMO. According to the present embodiment, a slit 105 is provided between the feed points 108*a* and 109*a* of the antenna element 102, and according to the length of the slit 105, the resonance frequency of the antenna element 102 is adjusted and the frequency at which isolation can be ensured between the feed points 108*a* and 109*a* is adjusted. The present embodiment is further characterized by providing the slit 105 with a trap circuit 106 and a reactance element 107, thus ensuring isolation at multiple frequencies.

Referring to FIG. 1, the antenna apparatus 101 includes the antenna element 102 and a ground conductor 103, each made of a rectangular conductive plate. The antenna element 102 and the ground conductor 103 are provided in parallel so as to overlap each other, with a certain distance therebetween. One side of the antenna element 102 and one side of the ground conductor 103 are arranged close to each other, and are mechanically and electrically connected to each other by linear connecting conductors 104*a* and 104*b*. The antenna element 102 is provided with a slit 105 having a certain width and a certain length, and extending between the side to which the connecting conductors 104*a* and 104*b* are connected, and its opposite side. One end of the slit 105 is configured as an open end, with an opening at about the center of the opposite side of the side to which the connecting conductors 104*a* and 104*b* are connected, and the other end is configured as a closed end. On the antenna element 102, feed points 108*a* and 108*b* are provided such that the slit 105 is located between them. The feed points 108*a* and 108*b* are respectively connected with feed lines F1 and F3 which penetrate through the ground conductor 103 from its back side. Each of the feed lines F1 and F3 is, for example, a coaxial cable having a characteristic impedance of 50Ω. Signal lines F1*a* and F3*a* as inner conductors of the coaxial cables are respectively connected to the feed points 108*a* and 108*b*, and signal lines F1*b* and F3*b* as outer conductors of the coaxial cables are respectively connected to the ground conductor 103 at connection points 108*a* and 108*b*. The feed point 108*a* and the connecting point 108*b* act as one feed port of the antenna apparatus 101, and the feed point 109*a* and the connecting point 109*b* act as another feed port of the antenna apparatus 101. Further, the feed lines F1 and F3 are connected to impedance matching circuits (hereinafter, referred to as "matching circuits") 111 and 112, respectively, and the matching circuits 111 and 112 are connected to a MIMO communication circuit 113 through feed lines F2 and F4, respectively. Each of the feed lines F2 and F4 are also made of, for example, a coaxial cable having a characteristic impedance of 50Ω. The MIMO communication circuit 113 transmits and receives radio signals of multiple channels of a MIMO communication scheme (in the present embodiment, two channels) through the antenna element 102.

As shown in FIG. 1, the antenna apparatus 101 is configured as a planar inverted-F antenna apparatus. In a modified embodiment, the antenna element 102 and the ground conductor 103 may be connected by a single conductive plate, instead of connecting by the plurality of connecting conductors 104*a* and 104*b*.

The antenna apparatus 101 is further provided with the trap circuit 106 at a location along the slit 105 and remote from the opening of the slit 105 by a predetermined distance, in order to change the current path between the feed ports dependent on the operating frequency (described below in detail). By providing the antenna apparatus 101 with the trap circuit 106, the antenna apparatus 101 can ensure high isolation between the feed ports at two different frequencies (hereinafter, referred to as "isolation frequencies"). In addition, the antenna apparatus 101 is further provided with the reactance element 107 (i.e., a capacitor or an inductor) at a predetermined location along the slit 105 and more remote from the opening of the slit 105 than the trap circuit 106, in order to change the electrical length of the slit 105 at a lower one of the isolation frequencies (described below in detail). The operating frequencies of the matching circuits 111 and 112 and the MIMO communication circuit 113 change under the control of a controller 114. The controller 114 adjusts the operating frequencies of the matching circuits 111 and 112 and the MIMO communication circuit 113, thus selectively shifting the operating frequency of the antenna apparatus 101 to one of the two isolation frequencies.

Effects of providing the antenna element 102 with the slit 105 are as follows. Since the resonance frequency of the antenna element 102 and the frequency at which isolation can be ensured change dependent on the length of the slit 105, the length of the slit 105 is determined so as to adjust these frequencies. Specifically, providing the slit 105 decreases the resonance frequency of the antenna element 102 itself. Further, the slit 105 operates as a resonator dependent on the length of the slit 105. Since the slit 105 is electromagnetically coupled to the antenna element 102 itself, the resonance frequency of the antenna element 102 changes according to the resonance frequency of the slit 105, as compared to the case without the slit 105. Providing the slit 105 can change the resonance frequency of the antenna element 102, and also increase isolation between the feed ports at a certain frequency. In general, the frequency at which high isolation can be ensured by providing the slit 105 is not identical to the resonance frequency of the antenna element 102. Therefore, in the present embodiment, the matching circuits 111 and 112 are provided between the feed ports and the MIMO communication circuit 113, in order to shift the operating frequency of the antenna element 102 (i.e., a frequency at which a desired signal is transmitted and received) from the resonance frequency changed due to the slit 105, to the isolation frequency. As a result of providing the matching circuit 111, at a terminal of the matching circuit 111 on the side of the MIMO communication circuit 113 (i.e., a terminal on the side connected to the feed line F2), an impedance seen from the terminal to the antenna element 102 matches with an impedance seen from the terminal to the MIMO communication circuit 113 (i.e., a characteristic impedance of 50Ω of the feed line F2). Similarly, as a result of providing the matching circuit 112, at a terminal of the matching circuit 112 on the side of the MIMO communication circuit 113 (i.e., a terminal on the side connected to the feed line F4), an impedance seen from the terminal to the antenna element 102 matches with an impedance seen from the terminal to the MIMO communication circuit 113 (i.e., a characteristic impedance of 50Ω of the feed line F4). Providing the matching circuits 111 and 112 affects both the resonance frequency and the isolation frequency, but mainly contributes to changing the resonance frequency.

Effects of providing the slit 105 with the trap circuit 106 are as follows. The trap circuit 106 is substantially open only at a predetermined resonance frequency, and thus, the trap circuit 106 is used so as to be substantially open at a lower one of the two isolation frequencies, and to be substantially short-circuited at a higher one of the two isolation frequencies. Therefore, the trap circuit 106 allows the entire slit 105 to resonate at the lower one of the isolation frequencies, and allows only a section of the slit 105 from the opening to the trap circuit 106 to resonate at the higher one of the isolation frequencies. Thus, since the electrical length of the slit 105 changes dependent on a frequency, the antenna apparatus 101 of the present embodiment is configured to change the operating frequency of the antenna element 102 to change the electrical length of the slit 105, thus achieving two different resonance frequencies, and ensuring isolation between the feed ports at the two different frequencies. According to the present embodiment, it is possible to achieve two different isolation frequencies, by changing the operating frequency of the antenna element 102 to change the electrical length of the slit 105.

Figure 2:
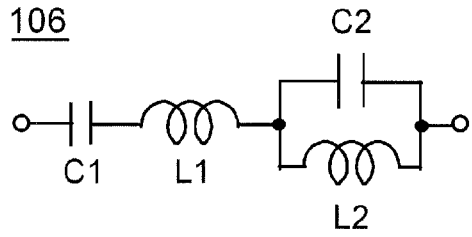
FIG. 2 is a circuit diagram showing an example of a trap circuit 106 of FIG. 1.
Figure 3:
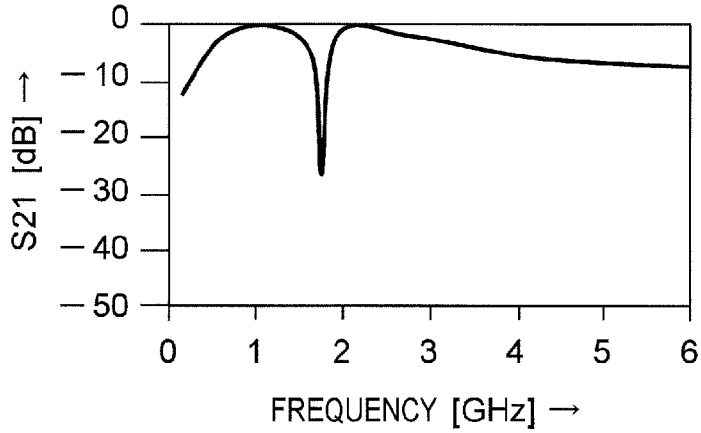
FIG. 3 is a graph showing a transmission coefficient parameter S21 versus frequency for the trap circuit 106 of FIG. 2.
Figure 4:
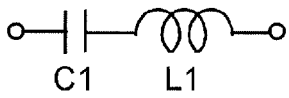
FIG. 4 is a circuit diagram showing a trap circuit of a comparative example.
Figure 5:
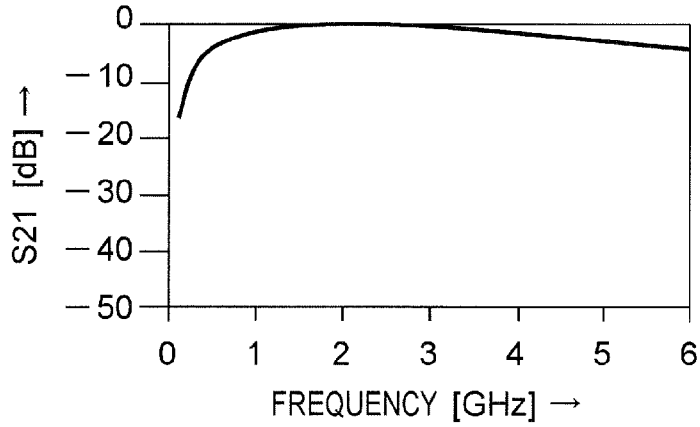
FIG. 5 is a graph showing a transmission coefficient parameter S21 versus frequency for the trap circuit of FIG. 4.

FIG. 2 is a circuit diagram showing an example of the trap circuit 106 of FIG. 1, and FIG. 3 is a graph showing a transmission coefficient parameter S21 versus frequency for the trap circuit 106 of FIG. 2. The circuit shown in FIG. 2 includes a series combination of a series circuit of an inductor L1 and a capacitor C1, with a parallel circuit of an inductor L2 and a capacitor C2. Since the impedance of the parallel circuit of the inductor L2 and the capacitor C2 becomes practically infinite at its resonance frequency $$f1=1/(2\pi\sqrt{L2\cdot C2}),$$

the trap circuit 106 of FIG. 2 is substantially electrically open at the frequency f1. In this case, if the circuit of FIG. 2 is implemented using, for example, C1=2.3 pF, L1=8.2 nH, C2=4.0 pF, and L2=2.2 nH, then as shown in FIG. 3, the amount of transmission is 0 dB (short circuited) at 2 GHz, and the amount of transmission is −30 dB (open) at 1.7 GHz. Therefore, it is possible to use 2 GHz as a higher one of the isolation frequencies, and use 1.7 GHz as a lower one of the isolation frequencies. For comparison, a trap circuit including only a series circuit of an inductor L1 and a capacitor C1 will be described. FIG. 4 is a circuit diagram showing a trap circuit of a comparative example, and FIG. 5 is a graph showing a transmission coefficient parameter S21 versus frequency for the trap circuit of FIG. 4. The impedance of the trap circuit of FIG. 4 becomes zero at a resonance frequency $$f2=1/(2\pi\sqrt{L1\cdot C1}),$$

and the impedance increases as a difference from the frequency f2 increases. Thus, the trap circuit of FIG. 4 can be substantially short-circuited at the frequency f2, and can be substantially open at other frequencies f3 (≠f2). In this case, if the circuit of FIG. 4 is implemented using, for example, C1=2.7 pF and L1=2.3 nH, then as shown in FIG. 5, the amount of transmission is −5 dB or more in a range of 500 MHz to 3000 MHz. Thus, the trap circuit is substantially short-circuited in a wide frequency range, and accordingly, in this frequency range, the isolation frequency includes only a frequency at which the section of the slit 105 from the opening to the trap circuit 106 resonates, and thus, it is not possible to increase isolation at multiple frequencies.

Figure 6:
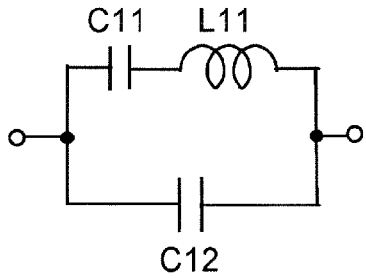
FIG. 6 is a circuit diagram showing a trap circuit according to a first modified embodiment of the first embodiment of the present invention.
Figure 7:
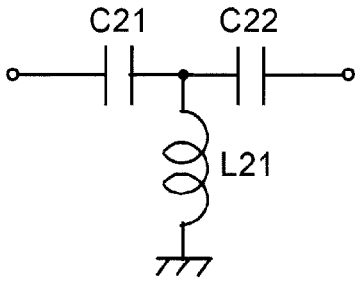
FIG. 7 is a circuit diagram showing a trap circuit according to a second modified embodiment of the first embodiment of the present invention.
Figure 8:
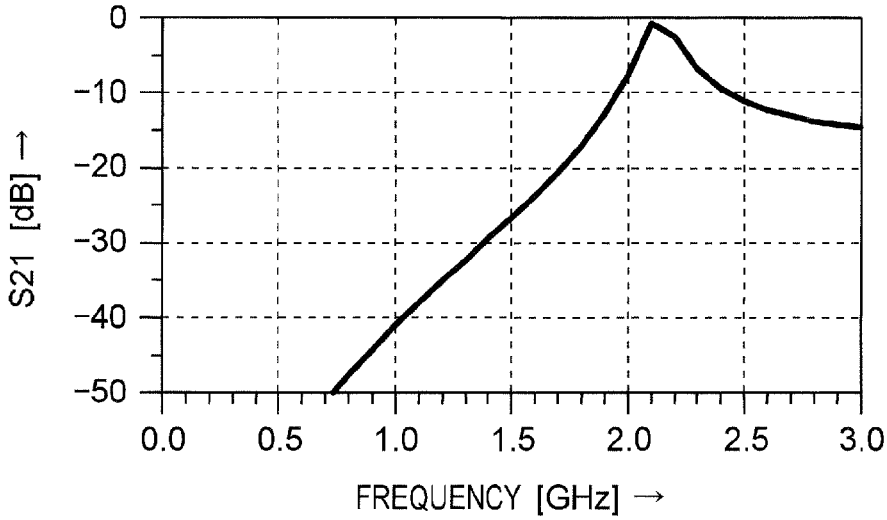
FIG. 8 is a graph showing a transmission coefficient parameter S21 versus frequency for the trap circuit of FIG. 7.

Note that the configuration of the trap circuit is not limited to the circuit configuration shown in FIG. 2. FIG. 6 is a circuit diagram showing a trap circuit according to a first modified embodiment of the first embodiment of the present invention. For example, as shown in FIG. 6, even if using a parallel combination of a series circuit of an inductor L11 and a capacitor C11, with a capacitor C12, it is possible to achieve the same effect as that of the circuit of FIG. 2. In addition, the trap circuit 106 may be a band-pass filter or a high-pass filter. FIG. 7 is a circuit diagram showing a trap circuit which is a band-pass filter, according to a second modified embodiment of the first embodiment of the present invention. FIG. 8 is a graph showing a transmission coefficient parameter S21 versus frequency for the trap circuit of FIG. 7. In this case, if the circuit of FIG. 7 is implemented using, for example, C21=0.1 pF, C22=0.1 pF, and L21=28 nH, then as shown in FIG. 8, the amount of transmission is 0 dB (short circuited) at 2.1 GHz. Therefore, 2.1 GHz can be used as a higher one of the isolation frequencies, and a frequency lower than 2.1 GHz can be used as a lower one of the isolation frequencies. In the case of using a high-pass filter, the filter operates in the same manner. Alternatively, the trap circuit may include a MEMS (Micro Electro Mechanical Systems) device.

Effects of providing the slit 105 with the reactance element 107 are as follows. In the case in which two isolation frequencies are used as in the present embodiment, at a higher one of the isolation frequencies, only the section of the slit 105 from the opening to the trap circuit 106 resonates, and thus, the isolation frequency is not significantly affected by presence/absence of the reactance element 107. However, at a lower one of the isolation frequencies, since the entire slit 105 resonates, providing the reactance element 107 changes the electrical length between the closed end of the slit 105 and the trap circuit 106. Thus, the isolation frequency can be adjusted. In the case of using a capacitor as the reactance element 107, increasing its capacitance increases the electrical length between the closed end of the slit 105 and the trap circuit 106, thus shifting the lower one of the isolation frequencies to a further lower frequency. According to the configuration described above, while using the small antenna apparatus 101, the antenna apparatus 101 can operate at multiple operating frequencies separated from each other by a large frequency interval. In addition, the reactance element 107 can also finely adjust the higher one of the isolation frequencies. Since the isolation frequency changes dependent also on the location along the slit 105 where the reactance element 107 is provided, the location of the reactance element 107 is determined so as to adjust two isolation frequencies.

Figure 9:
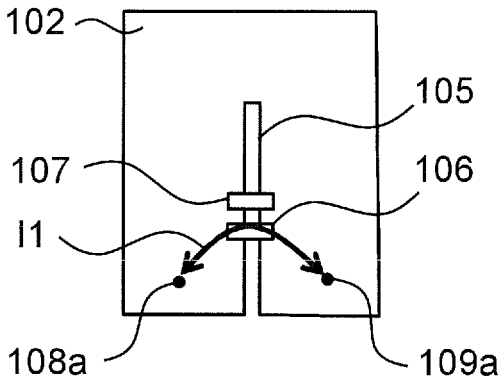
FIG. 9 is a diagram showing a current path I1 formed when the antenna apparatus 101 of FIG. 1 operates at a higher frequency.
Figure 10:
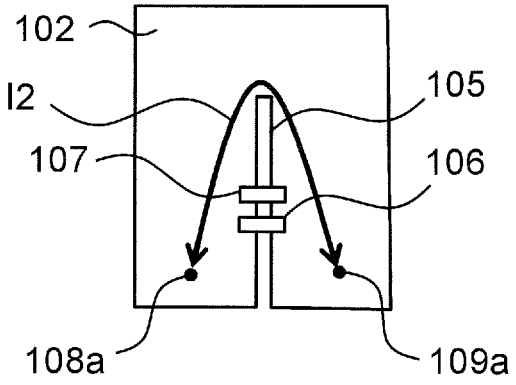
FIG. 10 is a diagram showing a current path I2 formed when the antenna apparatus 101 of FIG. 1 operates at a lower frequency.

As described above, the antenna apparatus 101 of the present embodiment is provided with the slit 105, the trap circuit 106, and the reactance element 107, and thus, it is possible to ensure high isolation between the feed ports at two isolation frequencies. With reference to FIGS. 9 and 10, current paths formed when the antenna apparatus 101 operates at two isolation frequencies will be described below. FIG. 9 is a diagram showing a current path I1 formed when the antenna apparatus 101 of FIG. 1 operates at a higher frequency. FIG. 10 is a diagram showing a current path 12 formed when the antenna apparatus 101 of FIG. 1 operates at a lower frequency. Referring to FIG. 9, when the antenna apparatus 101 operates at the higher one of the isolation frequencies, the trap circuit 106 is substantially short-circuited, and thus, in the slit 105, only the section of the slit 105 from the opening to the trap circuit 106 resonates, and the current path I1 between the feed points 108*a* and 109*a* passes through the trap circuit 106. The path length of the current path I1 is a half of an operating wavelength λ1. On the other hand, referring to FIG. 10, when the antenna apparatus 101 operates at the lower one of the isolation frequencies, the trap circuit 106 is substantially open, and thus, the entire slit 105 resonates, and the current path I2 between the feed points 108*a* and 109*a* detours around the closed end of the slit 105 without passing through the trap circuit 106. The path length of the current path 12 is a half of an operating wavelength λ2 and is longer than the path length of the current path I1.

According to the present embodiment having the above-described configuration, it is possible to operate the single antenna element 102 as two antenna portions, by exciting the antenna element 102 through one feed point 108*a* as a first antenna portion, and simultaneously, exciting the antenna element 102 through the other feed point 109*a* as a second antenna portion. As described above, according to the antenna apparatus 101 of the present embodiment, when operating the single antenna element 102 as two antenna portions, it is possible to ensure isolation between the feed ports at multiple isolation frequencies, while having a simple configuration, and thus, simultaneously transmit and/or receive multiple radio signals at each of the multiple isolation frequencies.

Second Embodiment

Figure 11:
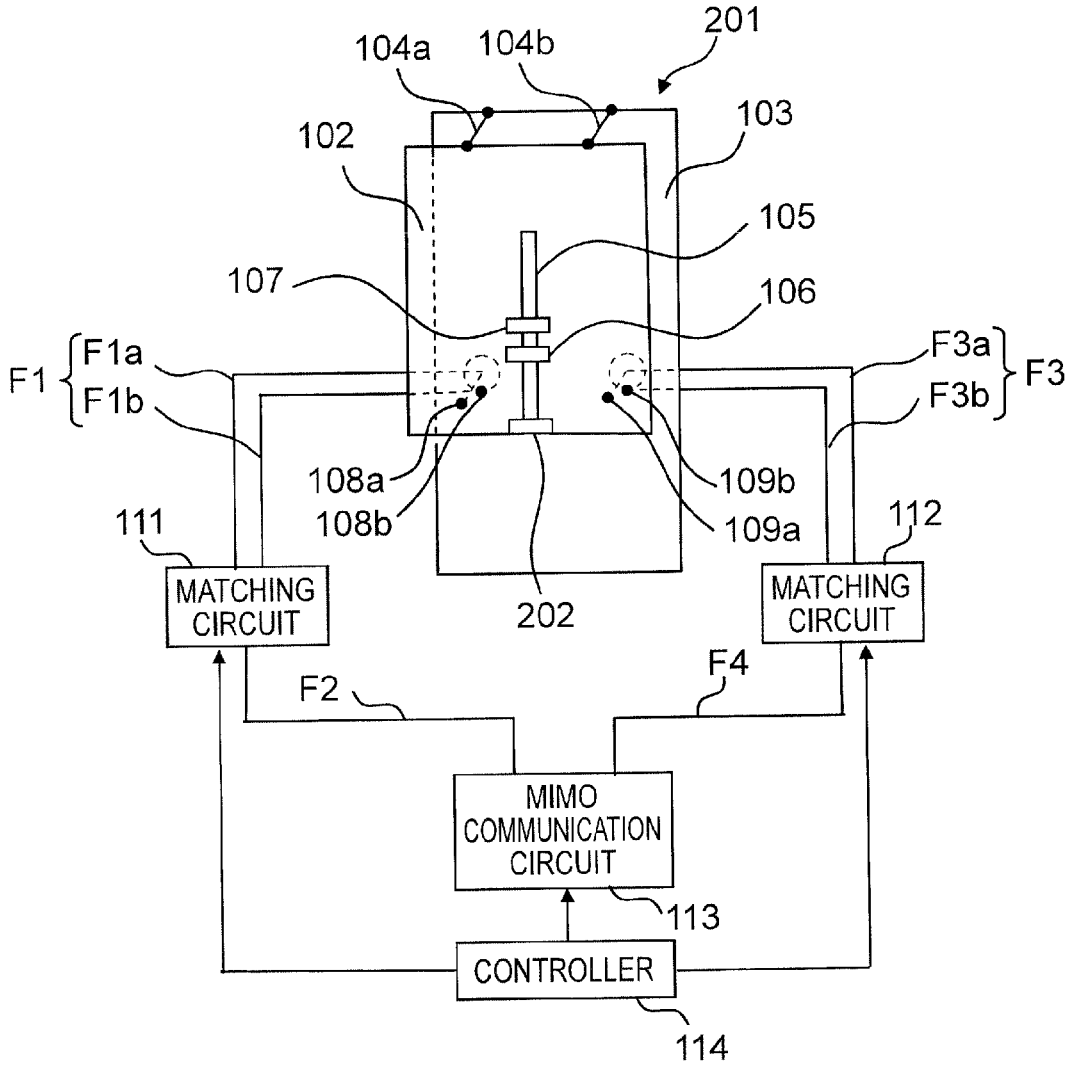
FIG. 11 is a block diagram showing schematic configurations of an antenna apparatus 201 according to a second embodiment of the present invention, and a wireless communication apparatus using the antenna apparatus 201.

FIG. 11 is a block diagram showing schematic configurations of an antenna apparatus 201 according to a second embodiment of the present invention, and a wireless communication apparatus using the antenna apparatus 201. The antenna apparatus of the present embodiment is characterized by having not only a reactance element 107 in a manner similar to that of the first embodiment, but also having another reactance element 202 at a predetermined location along a slit 105, in order to adjust the isolation frequencies.

Referring to FIG. 11, the antenna apparatus of the present embodiment has the configuration shown in FIG. 1, and is further provided with the reactance element 202 at a location along the slit 105 and remote from an opening of the slit 105 by a predetermined distance. Since the resonance frequency of an antenna element 102 and the frequency at which isolation can be ensured change dependent on the length of the slit 105, the length of the slit 105 is determined so as to adjust these frequencies. In the present embodiment, in order to adjust these frequencies, the reactance element 202 having a predetermined reactance value (i.e., a capacitor or an inductor) is further provided at a predetermined location along the slit 105. In addition, since these frequencies change dependent also on the location of the reactance element 202 along the slit 105, the location of the reactance element 202 is determined so as to adjust these frequencies. The amount of adjustment (amount of transition) of frequency reaches a maximum when the reactance element 202 is provided at the opening of the slit 105. From this fact, it is possible to finely adjust the resonance frequency of the antenna element 102 and the frequency at which isolation can be ensured, by determining a reactance value of the reactance element 202, and then displacing the location to mount of the reactance element 202.

Since only a section of the slit 105 from the opening to a trap circuit 106 resonates at a higher one of the isolation frequencies as described above, the isolation frequency is not significantly affected by the reactance element 107. On the other hand, the reactance element 202 of the present embodiment can make an adjustment at the higher one of the isolation frequencies such that a current path I1 between feed points 108*a* and 109*a* passes through the trap circuit 106, by changing the electrical length from the opening of the slit 105 to the trap circuit 106.

As described above, according to the antenna apparatus 201 of the present embodiment, when operating the single antenna element 102 as two antenna portions, it is possible to ensure isolation between feed ports at multiple isolation frequencies, while having a simple configuration, and thus, simultaneously transmit and/or receive multiple radio signals at each of the multiple isolation frequencies.

Third Embodiment

Figure 12:
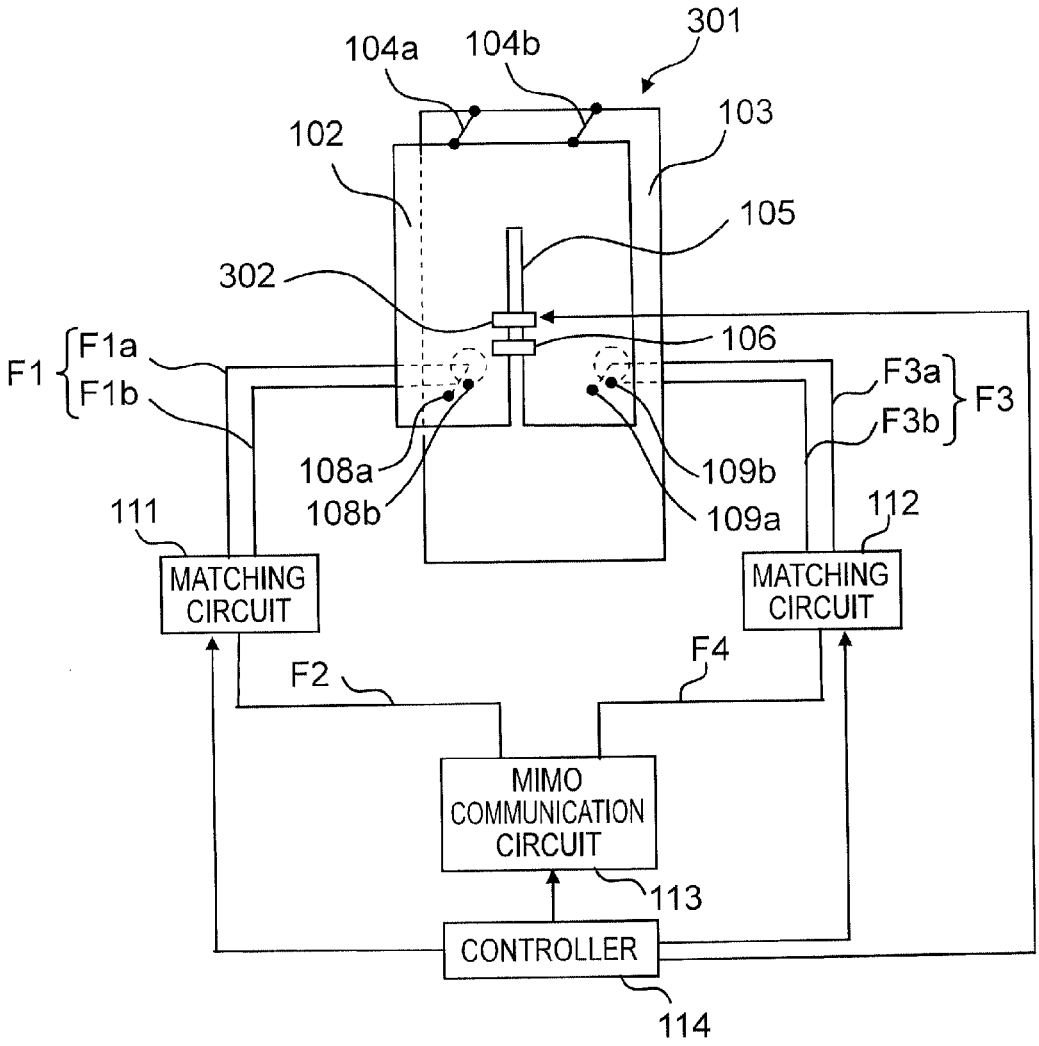
FIG. 12 is a block diagram showing schematic configurations of an antenna apparatus 301 according to a third embodiment of the present invention, and a wireless communication apparatus using the antenna apparatus 301.

FIG. 12 is a block diagram showing schematic configurations of an antenna apparatus 301 according to a third embodiment of the present invention, and a wireless communication apparatus using the antenna apparatus 301. The antenna apparatus 301 of the present embodiment is characterized by having a variable reactance element 302 whose reactance value changes under the control of a controller 114, instead of a reactance element 107 of the first embodiment. Thus, the antenna apparatus 301 of the present embodiment can ensure isolation between feed ports at multiple isolation frequencies, and further change the isolation frequencies.

A capacitive reactance element (e.g., a variable capacitance element such as a varactor diode) can be used for the variable reactance element 302. The reactance value of the variable reactance element 302 changes according to a control voltage applied from the controller 114. The antenna apparatus 301 of the present embodiment is configured to change the reactance value of the variable reactance element 302, thus achieving different resonance frequencies of an antenna element 102, and ensuring isolation between the feed ports at the different frequencies. The controller 114 changes the reactance value of the variable reactance element 302 and adjusts the operating frequencies of matching circuits 111 and 112 and a MIMO communication circuit 113, thus shifting the operating frequency of the antenna element 102 to an isolation frequency which is determined by the reactance value of the variable reactance element 302. According to the present embodiment having the above-described configuration, multi-frequency operation of the antenna apparatus is achieved.

According to the present embodiment, it is possible to change the operating frequency of the antenna element 102 according to an application to be used, by adaptively changing the reactance value of the variable reactance element 302.

As described above, according to the antenna apparatus 301 of the present embodiment, when operating the single antenna element 102 as two antenna portions, it is possible to ensure isolation between the feed ports at multiple isolation frequencies, while having a simple configuration, and thus, simultaneously transmit and/or receive multiple radio signals at each of the multiple isolation frequencies.

Fourth Embodiment

Figure 13:
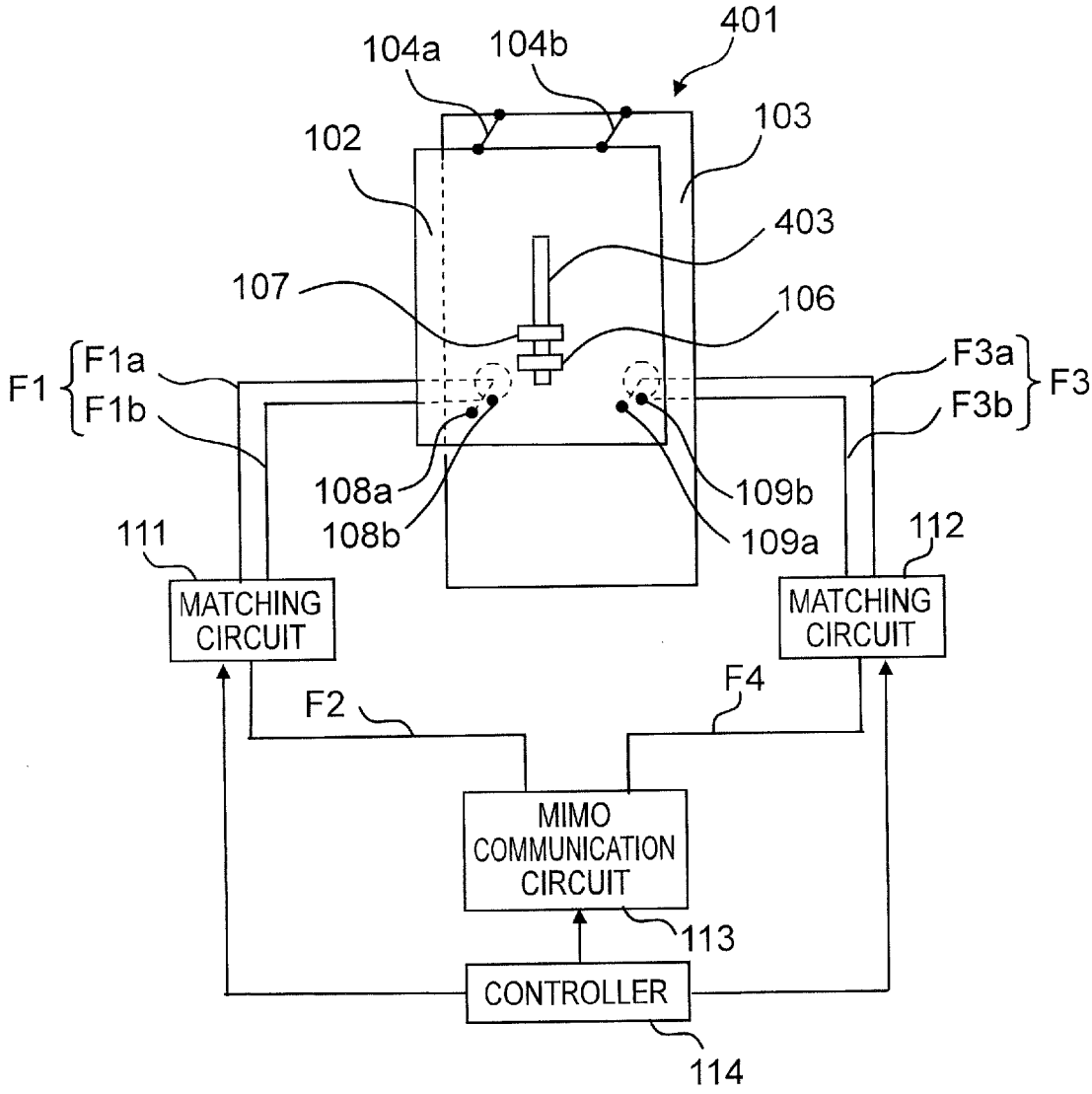
FIG. 13 is a block diagram showing schematic configurations of an antenna apparatus 401 according to a fourth embodiment of the present invention, and a wireless communication apparatus using the antenna apparatus 401.

FIG. 13 is a block diagram showing schematic configurations of an antenna apparatus 401 according to a fourth embodiment of the present invention, and a wireless communication apparatus using the antenna apparatus 401. The antenna apparatus 401 of the present embodiment is characterized by an antenna element 402 having a slot 403, instead of an antenna element 102 having a slit 105 of the first embodiment. The antenna element 402 is provided with the slot 403 having a certain width and a certain length, and extending between a side to which connecting conductors 104*a* and 104*b* are connected, and its opposite side. Both ends of the slot 403 are configured as closed ends. On the antenna element 402, feed points 108*a* and 108*b* are provided such that the slot 403 is located between them. The slot 403 has a first end close to the feed points 108*a* and 109*a*, and a second end remote from the feed points 108*a* and 109*a*. A trap circuit 106 is provided at a location along the slot 403 and remote from the first and second ends by predetermined distances. A reactance element 107 is provided along the slot 403 between the trap circuit 106 and the second end of the slot 403. Even when using such a configuration, when operating the single antenna element 402 as two antenna portions, it is possible to ensure isolation between feed ports at multiple isolation frequencies, while having a simple configuration, and thus, simultaneously transmit and/or receive multiple radio signals at each of the multiple isolation frequencies.

Fifth Embodiment

Figure 14:
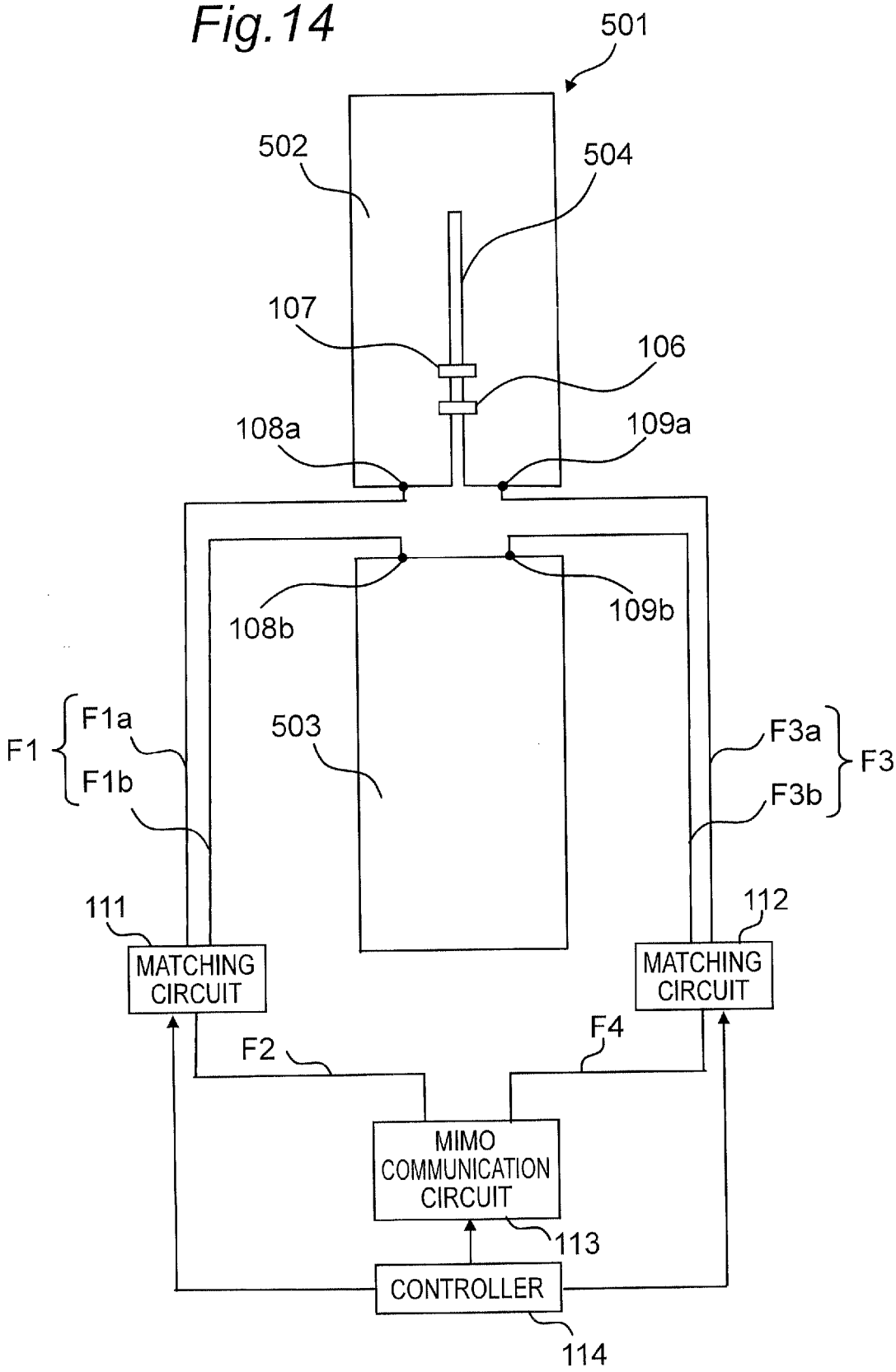
FIG. 14 is a block diagram showing schematic configurations of an antenna apparatus 501 according to a fifth embodiment of the present invention, and a wireless communication apparatus using the antenna apparatus 501.

FIG. 14 is a block diagram showing schematic configurations of an antenna apparatus 501 according to a fifth embodiment of the present invention, and a wireless communication apparatus using the antenna apparatus 501. The antenna apparatus of the present embodiment is characterized by being configured as a dipole antenna apparatus, instead of being configured as an inverted-F antenna apparatus such as those in the first to fourth embodiments.

Referring to FIG. 14, the antenna apparatus 501 includes the antenna element 502 and a ground conductor 503, each made of a rectangular conductive plate. The antenna element 502 and the ground conductor 503 are spaced apart from each other by a certain distance, such that one side of the antenna element 502 is opposed to one side of the ground conductor 503. Two feed ports are provided on the pair of opposing sides of the antenna element 502 and the ground conductor 503. One feed port includes the feed point 108*a* provided on the antenna element 502 at the side opposed to the ground conductor 503, and includes a connection point 108*b* provided on the ground conductor 503 at the side opposed to the antenna element 502. The other feed port includes the feed point 109*a* provided on the antenna element 502 at the side opposed to the ground conductor 503, and includes a connection point 109*b* provided on the ground conductor 503 at the side opposed to the antenna element 502. The antenna element 502 is further provided with the slit 504 between the two feed ports, i.e., between the feed points 108*a* and 109*a*, for adjusting electromagnetic coupling between the antenna portions and ensuring certain isolation between the feed ports. The slit 504 has a certain width and a certain length, and one end of the slit 504 is configured as an open end, with an opening on the side between the feed points 108*a* and 109*a*. The feed point 108*a* and the connection point 108*b* are connected to a matching circuit 111 through signal lines F1*a* and F1*b* (hereinafter, collectively referred to as "feed line F1"). The matching circuit 111 is connected to a MIMO communication circuit 113 through a feed line F2. Similarly, the feed point 109*a* and the connection point 109*b* are connected to a matching circuit 112 through signal lines F3*a* and F3*b* (hereinafter, collectively referred to as "feed line F3"). The matching circuit 112 is connected to the MIMO communication circuit 113 through a feed line F4. Each of the feed lines F1 and F3 is made of, e.g., a coaxial cable with a characteristic impedance of 50Ω in a manner similar to that of the first embodiment. Alternatively, each of the feed lines F1 and F3 may be made of a balanced feed line. According to the present preferred embodiment having the configuration as described above, it is possible to operate the single antenna element 502 as two antenna portions, by exciting the antenna element 502 as a first antenna portion through one feed port (i.e., the feed point 108*a*), and simultaneously, exciting the antenna element 502 as a second antenna portion through the other feed port (i.e., the feed point 109*a*).

In the case in which the ground conductor 503 is of a similar size to that of the antenna element 502 as illustrated in FIG. 14, the antenna apparatus 501 can be regarded as a dipole antenna made of the antenna element 502 and the ground conductor 503. The ground conductor 503 is excited as a third antenna portion through one feed port (i.e., the connection point 108*b*), and simultaneously excited as a fourth antenna portion through the other feed port (i.e., the connection point 109*b*), thus operating also the ground conductor 503 as two antenna portions. In this case, since an image (mirror image) of the slit 504 is formed on the ground conductor 503, it is also possible to ensure isolation between the feed ports for the third and fourth antenna portions. With the above-described configuration, it is possible to excite the first and third antenna portions as a first dipole antenna portion through one feed port, and simultaneously, excite the second and fourth antenna portions as a second dipole antenna portion through the other feed port, thus operating a single dipole antenna (i.e., the antenna element 502 and the ground conductor 503) as two dipole antenna portions. According to the antenna apparatus of the present embodiment, when operating a single dipole antenna as two dipole antenna portions, it is possible to ensure isolation between feed ports, while having a simple configuration, and thus, transmit and/or receive multiple radio signals simultaneously.

In the antenna apparatus 501 of the present embodiment, a slit may be provided not on the antenna element 502, but on the ground conductor 503. Alternatively, slits may be provided on both the antenna element 502 and the ground conductor 503.

As described above, according to the antenna apparatus 501 of the present embodiment, when operating the single antenna element 502 as two antenna portions, it is possible to ensure isolation between the feed ports at multiple isolation frequencies, while having a simple configuration, and thus, simultaneously transmit and/or receive multiple radio signals at each of the multiple isolation frequencies.

First Implementation Example

Figure 15:
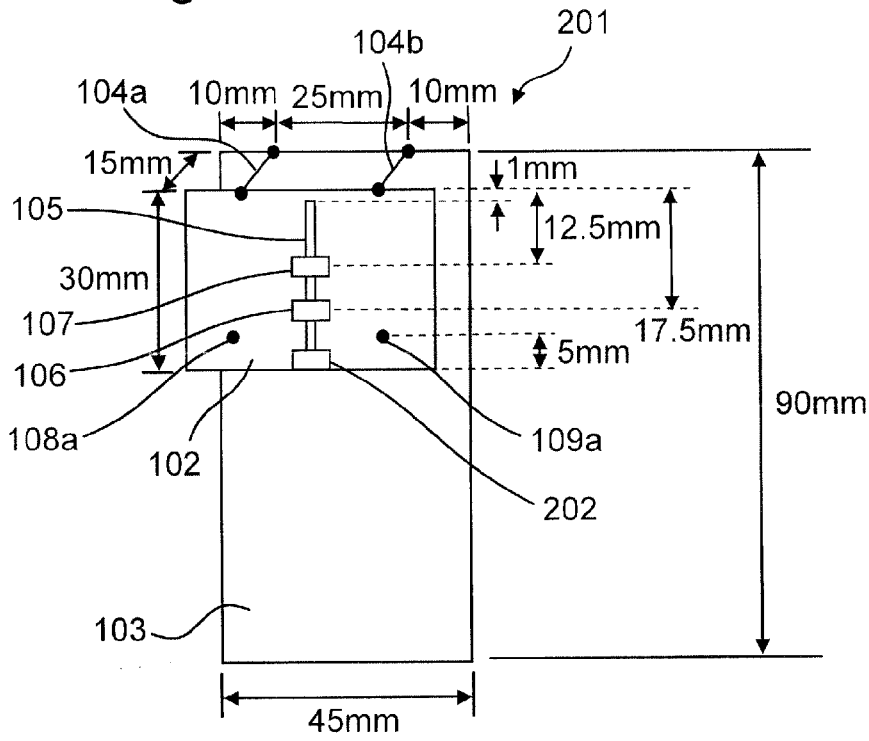
FIG. 15 is a perspective view showing a configuration of an antenna apparatus 201 according to a first implementation example of the second embodiment of the present invention.
Figure 16:
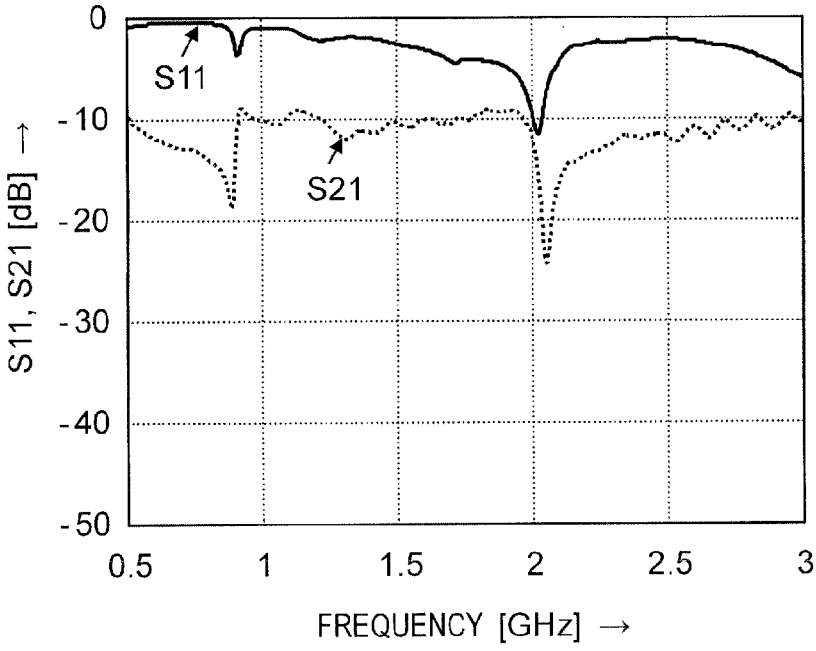
FIG. 16 is a graph showing a reflection coefficient parameter S11 versus frequency and a transmission coefficient parameter S21 versus frequency for the antenna apparatus 201 of FIG. 15.

Simulation results for an antenna apparatus 201 of the second embodiment being modeled as a slit antenna apparatus made of copper plates will be described below. FIG. 15 is a perspective view showing a configuration of an antenna apparatus 201 according to a first implementation example of the second embodiment of the present invention. FIG. 16 is a graph showing a reflection coefficient parameter S11 versus frequency and a transmission coefficient parameter S21 versus frequency for the antenna apparatus 201 of FIG. 15.

Referring to FIG. 15, each of an antenna element 102 and a ground conductor 103 was made of a single-sided copper-clad board. The antenna element 102 had a size of 30×45 mm, and the ground conductor 103 had a size of 45×90 mm. The antenna element 102 was disposed in parallel to the ground conductor 103 and 15 mm above the ground conductor 103. A slit 105 was formed by removing conductor from the center across the width of the antenna element 102 by a width of 1 mm, except for its upper end by 1 mm. The antenna element 102 and the ground conductor 103 were connected by connecting conductors 104*a* and 104*b* at locations remote from both ends by 10 mm in the width direction of the antenna element 102. A reactance element 202 was mounted at a lower end of the slit 105 across the slit 105. A trap circuit 106 was mounted at a location remote from an upper end of the slit 105 by 17.5 mm. A reactance element 107 was mounted at a location remote from the upper end of the slit 105 by 12.5 mm. The trap circuit 106 was configured in the same manner as in FIG. 2, and was implemented using C1=2.3 pF, L1=8.2 nH, C2=4.0 pF, and L2=2.2 nH. The reactance element 202 was a capacitor of 0.1 pF, and the reactance element 107 was an capacitor of 8 pF.

According to FIG. 16, it can be seen that the transmission coefficient parameter S21 falls below −17.5 dB at 850 MHz and 2000 MHz, and thus, low coupling can be achieved at these frequencies.

Although the first implementation example shows the case of using 850 MHz and 2000 MHz as isolation frequencies, the isolation frequencies are not limited to these frequencies. In addition, by changing the reactance element 107, it is possible to mainly shift a lower one of the isolation frequencies to a further lower frequency or to a higher frequency. In addition, by changing the location of the reactance element 107 or the trap circuit 106, it is possible to shift the lower one and the higher one of the isolation frequencies.

Second Implementation Example

Figure 17:
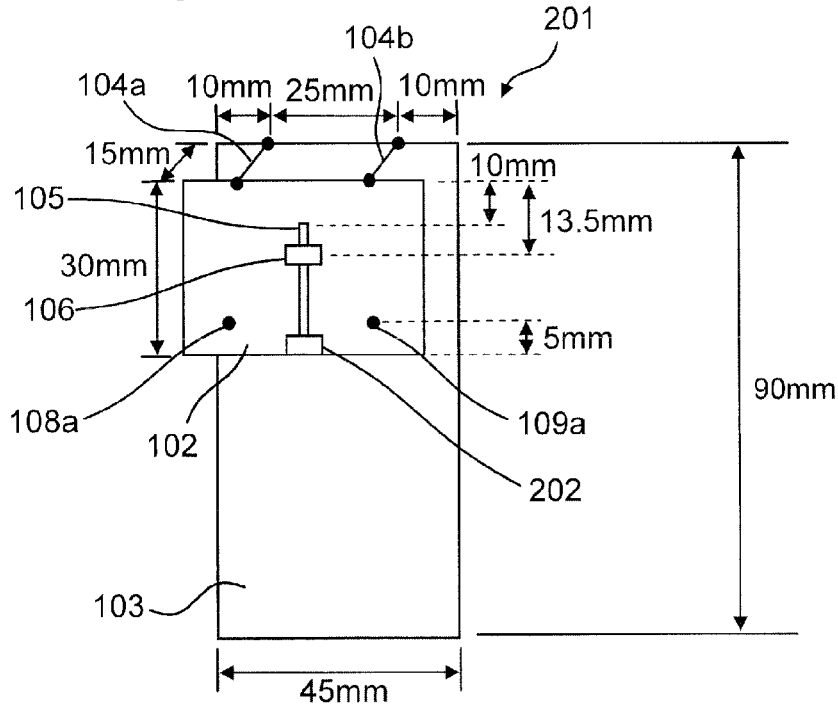
FIG. 17 is a perspective view showing a configuration of an antenna apparatus 201 according to a second implementation example of the second embodiment of the present invention.
Figure 18:
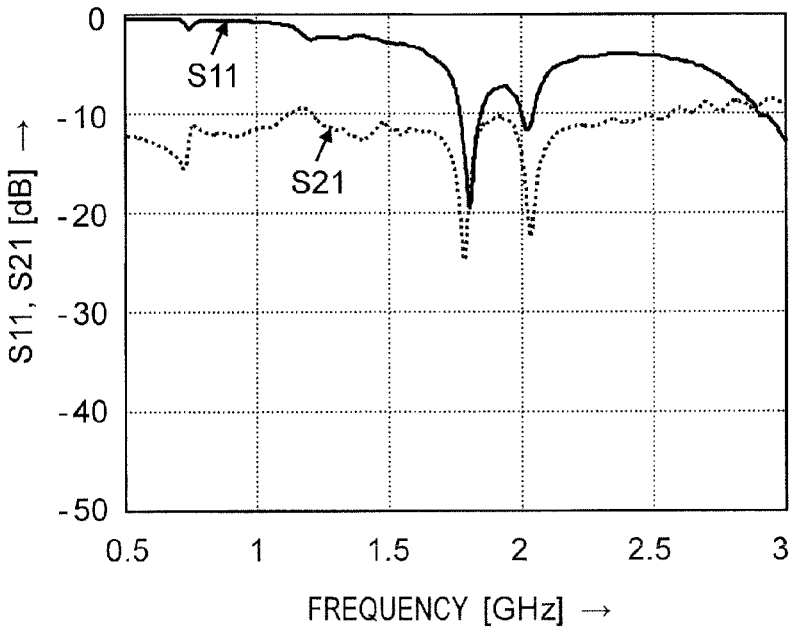
FIG. 18 is a graph showing a reflection coefficient parameter S11 versus frequency and a transmission coefficient parameter S21 versus frequency for the antenna apparatus 201 of FIG. 17.

For comparison, simulation results for an antenna apparatus 201 different from that of the first implementation example will be described. FIG. 17 is a perspective view showing a configuration of an antenna apparatus 201 according to a second implementation example of the second embodiment of the present invention. FIG. 18 is a graph showing a reflection coefficient parameter S11 versus frequency and a transmission coefficient parameter S21 versus frequency for the antenna apparatus 201 of FIG. 17.

Referring to FIG. 17, a slit 105 was formed over 20 mm from its lower end (opening). A reactance element 202 was mounted at the lower end of the slit 105 across the slit 105. A trap circuit 106 was mounted at a location remote from an upper end of the slit 105 by 13.5 mm. A reactance element 107 of FIG. 15 was removed. The other configurations are the same as those of an antenna apparatus 201 of FIG. 15.

According to FIG. 18, it can be seen that the transmission coefficient parameter S21 falls below −20 dB at 1800 MHz and 2000 MHz, and thus, low coupling can be achieved at these frequencies.

Modified Embodiments

The above-described first to fifth embodiments may be combined. For example, by combining the third and fourth embodiments, it is possible to use a variable reactance element, instead of a reactance element 107 of an antenna apparatus 401 according to the fourth embodiment. Although the embodiments only show the case of using two isolation frequencies, it is possible to operate at multiple resonance frequency as many as the number of trap circuits, by providing a plurality of trap circuits each substantially short-circuited at a different frequency. In addition, the shapes of an antenna element 102 and a ground conductor 103 are not limited to a rectangle and may be any other shape, e.g., a polygon, a circle, or an ellipse. Further, it is possible to use a wireless communication circuit for modulating and demodulating two independent radio signals, instead of using a MIMO communication circuit 113. In this case, the antenna apparatuses of the embodiments can simultaneously perform wireless communications for multiple applications, or simultaneously perform wireless communications in multiple frequency bands.

INDUSTRIAL APPLICABILITY

Antenna apparatuses of the present invention and wireless communication apparatuses using the antenna apparatuses of the present invention can be implemented as, for example, mobile phones, or can also be implemented as apparatuses for a wireless LAN. The antenna apparatuses can be mounted on, for example, wireless communication apparatuses for MIMO communication. In addition to MIMO apparatuses, the antenna apparatuses can also be mounted on (multi-application) wireless communication apparatuses operable to simultaneously perform communications for multiple applications.

REFERENCE SIGNS LIST

101, 201, 301, 401, and 501: ANTENNA APPARATUS,
102, 402, and 502: ANTENNA ELEMENT,
103 and 503: GROUND CONDUCTOR,
104*a* and 104*b*: CONNECTING CONDUCTOR,
105 and 504: SLIT,
106: TRAP CIRCUIT,
107 and 202: REACTANCE ELEMENT,
108*a* and 109*a*: FEED POINT,
108*b* and 109*b*: CONNECTING POINT,
111 and 112: IMPEDANCE MATCHING CIRCUIT,
113: MIMO COMMUNICATION CIRCUIT,
114: CONTROLLER,
302: VARIABLE REACTANCE ELEMENT,
403: SLOT,
C1, C2, C11, C12, C21, and C22: CAPACITOR,
L1, L2, L11, and L21: INDUCTOR,
F1, F2, F3, and F4: FEED LINE,
F1*a*, F1*b*, F3*a*, and F3*b*: SIGNAL LINE, and
I1 and I2: CURRENT PATH.

The invention claimed is:

1. An antenna apparatus having first and second feed ports respectively provided at predetermined locations on an antenna element, wherein the antenna element is simultaneously excited through the first and second feed ports so as to simultaneously operate as first and second antenna portions respectively associated with the first and second feed ports, wherein the antenna element is excited at one of a first frequency and a second frequency higher than the first frequency, and wherein the antenna apparatus comprises:

an electromagnetic coupling adjuster provided between the first and second feed ports, the electromagnetic coupling adjuster providing isolation between the first and second feed ports at each of the first and second frequencies;

a trap circuit provided on the electromagnetic coupling adjuster, the trap circuit that allows the electromagnetic coupling adjuster to provide the isolation at the first frequency when the antenna element is excited at the first frequency, and allows the electromagnetic coupling adjuster to provide the isolation at the second frequency when the antenna element is excited at the second frequency; and a first resonance frequency adjuster provided on the electromagnetic coupling adjuster, the first resonance frequency adjuster shifting a frequency at which the electromagnetic coupling adjuster provides isolation between the first and second feed ports, to the first frequency, when the antenna element is excited at the first frequency.

2. The antenna apparatus as claimed in claim 1, wherein when the antenna element is excited at the first frequency, the trap circuit is substantially open, and a first current path is formed on the antenna element and between the first and second feed ports, the first current path not passing through the trap circuit, and wherein when the antenna element is excited at the second frequency, the trap circuit is substantially short-circuited, and a second current path is formed on the antenna element and between the first and second feed ports, the second current path passing through the trap circuit.

3. The antenna apparatus as claimed in claim 1, wherein the first resonance frequency adjuster is a reactance element.

4. The antenna apparatus as claimed in claim 1, wherein the first resonance frequency adjuster is a variable reactance element, and wherein the antenna apparatus further comprises a controller controlling a reactance value of the variable reactance element.

5. The antenna apparatus as claimed in claim 1, further comprising a second resonance frequency adjuster provided on the electromagnetic coupling adjuster, the second resonance frequency adjuster shifting a frequency at which the electromagnetic coupling adjuster provides isolation between the first and second feed ports, to the second frequency, when the antenna element is excited at the second frequency.

6. The antenna apparatus as claimed in claim 1, wherein the electromagnetic coupling adjuster is a slit provided on the antenna element, wherein the trap circuit is provided at a location along the slit and remote from an opening of the slit by a predetermined distance, and wherein the first resonance frequency adjuster is provided at a location along the slit and more remote from the opening of the slit than the trap circuit.

7. The antenna apparatus as claimed in claim 1, wherein the electromagnetic coupling adjuster is a slot provided on the antenna element, and the slot has a first end close to the first and second feed ports, and a second end remote from the first and second feed ports, wherein the trap circuit is provided at a location along the slot and remote from the first and second ends by predetermined distances, and wherein the first resonance frequency adjuster is provided along the slot between the trap circuit and the second end.

8. The antenna apparatus as claimed in claim 1, wherein the trap circuit is formed by connecting a series resonant circuit in series with a parallel resonant circuit, the series resonant circuit including a first inductor and a first capacitor, and the parallel resonant circuit including a second inductor and a second capacitor.

9. The antenna apparatus as claimed in claim 1, wherein the trap circuit is formed by connecting a series resonant circuit, including an inductor and a first capacitor, in parallel with a second capacitor.

10. The antenna apparatus as claimed in claim 1, wherein the trap circuit is a band-pass filter.

11. The antenna apparatus as claimed in claim 1, wherein the trap circuit is a high-pass filter.

12. A wireless communication apparatus that transmits and receives multiple radio signals, the wireless communication apparatus comprising an antenna apparatus having first and second feed ports respectively provided at predetermined locations on an antenna element, wherein the antenna element is simultaneously excited through the first and second feed ports so as to simultaneously operate as first and second antenna portions respectively associated with the first and second feed ports, wherein the antenna element is excited at one of a first frequency and a second frequency higher than the first frequency, and wherein the antenna apparatus comprises:

an electromagnetic coupling adjuster provided between the first and second feed ports, the electromagnetic coupling adjuster providing isolation between the first and second feed ports at each of the first and second frequencies;

a trap circuit provided on the electromagnetic coupling adjuster, the trap circuit that allows the electromagnetic coupling adjuster to provide the isolation at the first frequency when the antenna element is excited at the first frequency, and allows the electromagnetic coupling adjuster to provide the isolation at the second frequency when the antenna element is excited at the second frequency; and a first resonance frequency adjuster provided on the electromagnetic coupling adjuster, the first resonance frequency adjuster shifting a frequency at which the electromagnetic coupling adjuster provides isolation between the first and second feed ports, to the first frequency, when the antenna element is excited at the first frequency.

* * * * *